US010268142B2

(12) United States Patent
Ono

(10) Patent No.: US 10,268,142 B2
(45) Date of Patent: Apr. 23, 2019

(54) CLEANING APPARATUS THAT REDUCES BACKFLOW OF TONER TO INTERMEDIATE TRANSFER BELT SIDE AND IMAGE FORMING APPARATUS

(71) Applicant: KYOCERA Document Solutions Inc., Osaka (JP)

(72) Inventor: Tomohisa Ono, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 24 days.

(21) Appl. No.: 15/873,519

(22) Filed: Jan. 17, 2018

(65) Prior Publication Data

US 2018/0217525 A1 Aug. 2, 2018

(30) Foreign Application Priority Data

Jan. 31, 2017 (JP) ..... 2017-016049

(51) Int. Cl.
*G03G 15/16* (2006.01)
*G03G 15/00* (2006.01)

(52) U.S. Cl.
CPC ..... *G03G 15/161* (2013.01); *G03G 15/5054* (2013.01); *G03G 2215/1661* (2013.01)

(58) Field of Classification Search
CPC ..... G03G 15/161; G03G 15/5054; G03G 2215/1661
USPC ..... 399/101, 123
See application file for complete search history.

(56) References Cited

U.S. PATENT DOCUMENTS

2014/0072340 A1* 3/2014 Kato ..... G03G 15/1605 399/121
2014/0294432 A1* 10/2014 Yonemoto ..... G03G 15/161 399/101
2015/0117897 A1* 4/2015 Shibuya ..... G03G 15/168 399/101

FOREIGN PATENT DOCUMENTS

JP 2012-203331 A 10/2012
JP 2012-215701 A 11/2012

* cited by examiner

*Primary Examiner* — Billy James M Lactaoen
(74) *Attorney, Agent, or Firm* — Stein IP, LLC

(57) ABSTRACT

A cleaning apparatus removes a toner and a paper dust remaining on an intermediate transfer belt. The pressure reducing member includes a fitting hole and an outer peripheral portion. The fitting hole is fitted to a rotation shaft of a rotation roller rotating at which the intermediate transfer belt is stretched. The outer peripheral portion is in a cam shape and has a diameter dimension larger than a diameter of the rotation roller. The outer peripheral portion is located around the fitting hole. The outer peripheral portion includes a first outer peripheral portion and a second outer peripheral portion. The first outer peripheral portion has a predetermined first radius and does not contact the supporting member when not reducing the pressure. The second outer peripheral portion has a predetermined cam radius larger than the first radius. The second outer peripheral portion contacts the supporting member when reducing the pressure.

5 Claims, 8 Drawing Sheets

COMPARATIVE EXAMPLE

CLEANING APPARATUS THAT REDUCES BACKFLOW OF TONER TO INTERMEDIATE TRANSFER BELT SIDE AND IMAGE FORMING APPARATUS

INCORPORATION BY REFERENCE

This application is based upon, and claims the benefit of priority from, corresponding Japanese Patent Application No. 2017-016049 filed in the Japan Patent Office on Jan. 31, 2017, the entire contents of which are incorporated herein by reference.

BACKGROUND

Unless otherwise indicated herein, the description in this section is not prior art to the claims in this application and is not admitted to be prior art by inclusion in this section.

A typical image forming apparatus includes, for example, a well-known electrophotographic method image forming apparatus. The electrophotographic method is constituted of five processes of: evenly charging a photosensitive element that does not have an electric charge (a charging process); irradiating a surface of the photosensitive element having the electric charge with a laser beam based on a copy document to form a latent image of the document on the photosensitive element surface (an exposure process); visualizing and imaging the latent image with a toner (a development process); transferring the toner image formed by visualizing and imaging on a recording medium, such as a paper sheet placed on an intermediate transfer belt (a transfer process); and fixing the transferred toner image on the recording medium (a fixation process).

Since some toner remains on the intermediate transfer belt after the toner image is transferred on the recording medium, the remaining toner needs to be removed before the next image formation process. In view of this, various cleaning apparatuses to remove the remaining toner has been proposed and practically used in the image forming apparatus.

A cleaning apparatus, for example, includes a pre-brush, a fur brush roller (a removal roller), a recovery roller, a cleaning blade, and a toner housing portion. The pre-brush charges the remaining toner on the intermediate transfer belt. The fur brush roller removes the toner charged by the pre-brush to clean a surface of the intermediate transfer belt. The recovery roller recovers the toner attached to the fur brush roller. The cleaning blade abuts on a circumference surface of the recovery roller and scrapes off the toner recovered by the recovery roller. The toner housing portion temporarily houses the toner scraped off by the cleaning blade. In the cleaning apparatus, the toner scraped off by the cleaning blade moves to the toner housing portion, the toner moved to the toner housing portion is transported to one end portion in the toner housing portion by a transport screw, and the transported toner is discharged to an outside of the cleaning apparatus from an opening formed in the one end portion in the toner housing portion.

SUMMARY

A cleaning apparatus according to one aspect of the disclosure removes a toner and a paper dust remaining on an intermediate transfer belt. The cleaning apparatus includes a pressing member, a pre-brush, a supporting member, a removal roller, a recovery roller, a cleaning blade, a sealing member, a toner housing portion, and a pressure reducing member. The pre-brush contacts the intermediate transfer belt in a state of pressed to a side of the intermediate transfer belt with a predetermined pressure by the pressing member to charge the toner remaining on the intermediate transfer belt. The supporting member is located between the pressing member and the pre-brush. The supporting member supports the pre-brush movably in a separating direction to separate from the intermediate transfer belt. The removal roller includes a first rotation shaft extending in a width direction of the intermediate transfer belt and removes the paper dust and the toner charged by the pre-brush on the intermediate transfer belt while contacting the intermediate transfer belt around the first rotation shaft. The recovery roller includes a second rotation shaft in parallel to an axial direction of the first rotation shaft and recovers the toner and the paper dust on the removal roller from the removal roller by contacting the removal roller while rotating about the second rotation shaft. The cleaning blade extends in parallel to an axial direction of the second rotation shaft. The cleaning blade contacts the recovery roller to scrape off the toner and the paper dust on the recovery roller. The sealing member runs in parallel to the first and the second rotation shafts. The toner housing portion is separated from the removal roller and the recovery roller by the sealing member. The toner housing portion houses the toner and the paper dust recovered by the recovery roller and scraped off by the cleaning blade. The pressure reducing member moves the pre-brush in the separating direction by pressing the supporting member in a direction opposite to pressing by the pressing member to reduce the pressure onto the pre-brush by the pressing member at every predetermined constant period. The pressure reducing member includes a fitting hole and an outer peripheral portion. The fitting hole is fitted to a rotation shaft of a rotation roller rotating at which the intermediate transfer belt is stretched. The outer peripheral portion is in a cam shape and has a diameter dimension larger than a diameter of the rotation roller. The outer peripheral portion is located around the fitting hole. The outer peripheral portion includes a first outer peripheral portion and a second outer peripheral portion. The first outer peripheral portion has a predetermined first radius. The first outer peripheral portion does not contact the supporting member when not reducing the pressure. The second outer peripheral portion has a predetermined cam radius larger than the first radius. The second outer peripheral portion contacts the supporting member when reducing the pressure.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
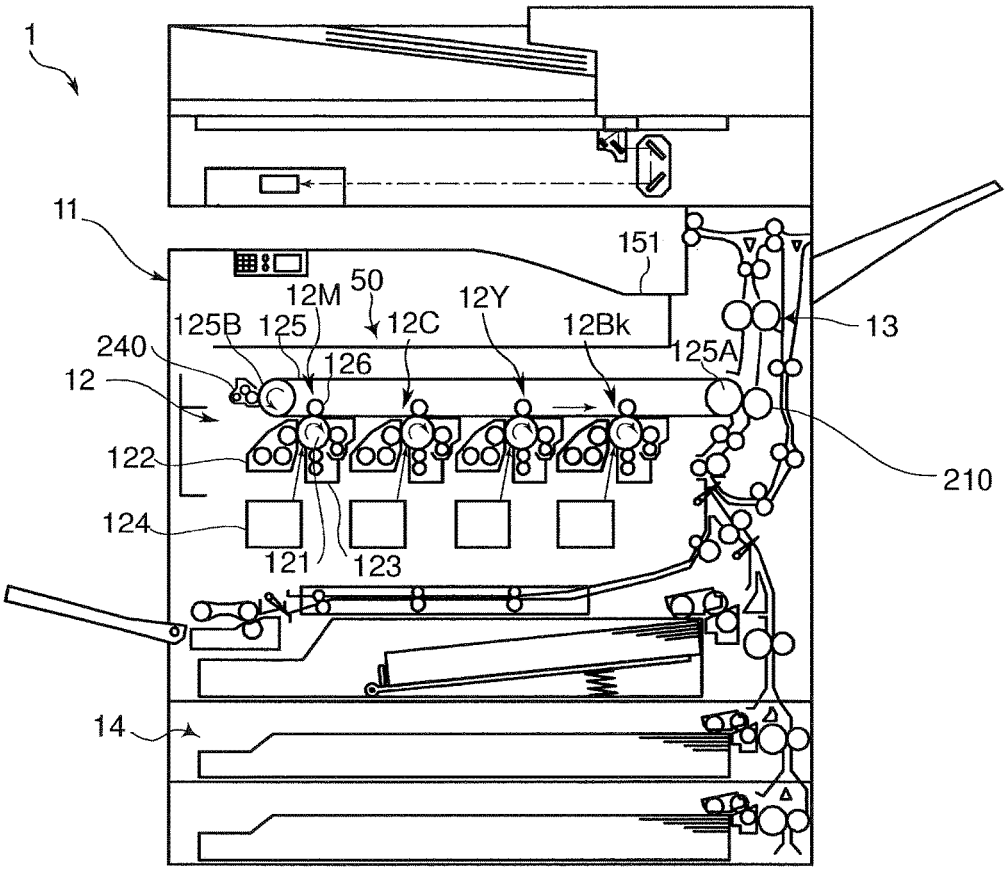
FIG. 1 illustrates a front cross-sectional view illustrating a structure of an image forming apparatus including a cleaning apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes a cleaning apparatus and an image forming apparatus according to one embodiment of the disclosure with reference to the drawings. FIG. 1 illustrates a front cross-sectional view illustrating a structure of the image forming apparatus including the cleaning apparatus according to the one embodiment of the disclosure.

An image forming apparatus 1 is a multi-functional peripheral having a plurality of functions, such as a copy function, a printer function, a scanner function, and a facsimile function. The image forming apparatus 1 is constituted by including, for example, an image forming unit 12, a fixing unit 13, and a paper sheet feeder 14 in an apparatus main body 11.

When the image forming apparatus 1 performs an image forming operation, the image forming unit 12 forms a toner image on a recording sheet fed from the paper sheet feeder 14 based, for example, on image data generated by a document reading operation or image data stored in a built-in HDD.

An image forming unit 12M for magenta, an image forming unit 12C for cyan, an image forming unit 12Y for yellow, and an image forming unit 12Bk for black of the image forming unit 12 each includes a photoreceptor drum 121, a developing device 122, a charging apparatus 123, an exposure apparatus 124, and a primary transfer roller 126.

For color printing, the image forming units 12M, 12C, 12Y, and 12Bk form a toner image on the photoreceptor drum 121 based on images formed of respective color components constituting the image data through processes of charging, exposure, and development. Then, the primary transfer roller 126 causes the toner images to be transferred on an intermediate transfer belt (an image carrier) 125 stretched by a drive roller 125A and a driven roller (a rotation roller) 125B.

The toner images with the respective colors to be transferred on the intermediate transfer belt 125 are superimposed on the intermediate transfer belt 125 while the transfer timing is adjusted, thus forming a color toner image. A secondary transfer roller 210 causes the color toner image formed on the surface of the intermediate transfer belt 125 to be transferred on the recording sheet conveyed from the paper sheet feeder 14 at a nip portion with the drive roller 125A sandwiching the intermediate transfer belt 125. Thereafter, the fixing unit 13 causes the toner image on the recording sheet to be fixed on the recording sheet by heat fixing. The color-image-formed recording sheet on which the fixing process has been completed is discharged to a discharge tray 151.

A cleaning apparatus 240 is located at a portion of the intermediate transfer belt 125 stretched by the driven roller 125B. The cleaning apparatus 240 recovers a remaining (remnant) toner on an outer peripheral surface of the intermediate transfer belt 125. The cleaning apparatus 240 recovers a remaining paper dust on the outer peripheral surface of the intermediate transfer belt 125.

The intermediate transfer belt 125, the primary transfer roller 126, the drive roller 125A, and the driven roller 125B, and furthermore, the cleaning apparatus 240 are implemented in an intermediate transfer unit 50.

Figure 2A:
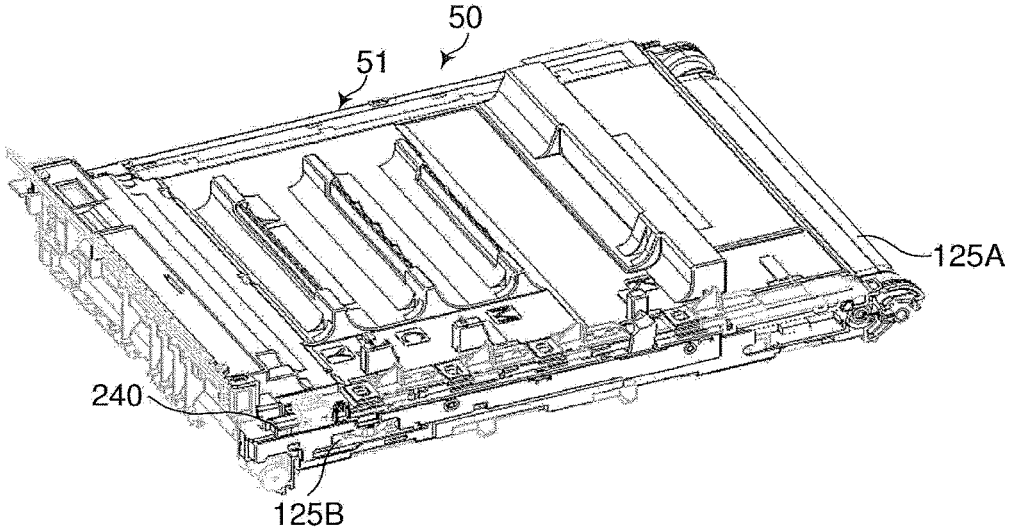
FIG. 2A obliquely illustrates an external appearance of an intermediate transfer unit including the cleaning apparatus according to the one embodiment.
Figure 2B:
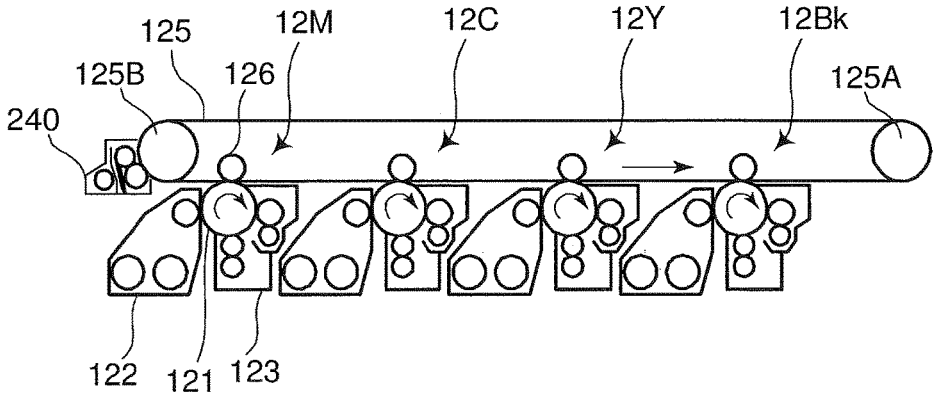
FIG. 2B illustrates a cross-sectional view illustrating a configuration of the intermediate transfer unit and a peripheral of the intermediate transfer unit.

FIG. 2A obliquely illustrates an external appearance of the intermediate transfer unit including the cleaning apparatus according to the one embodiment of the disclosure. FIG. 2B illustrates a cross-sectional view illustrating a configuration of the intermediate transfer unit and a peripheral of the intermediate transfer unit. The intermediate transfer unit 50 is installed above the image forming unit 12 within the apparatus main body 11. The intermediate transfer unit 50 implements the intermediate transfer belt 125, the primary transfer roller 126, the drive roller 125A, the driven roller 125B, and the cleaning apparatus 240 as described above.

The intermediate transfer unit 50 includes a casing 51. In the casing 51, respective mechanisms included in the intermediate transfer unit 50 are installed. One end portion of the casing 51 rotatably supports the drive roller 125A and the other end portion supports the driven roller 125B. The intermediate transfer belt 125 has an upper portion and both side portions covered with the casing 51 in a state of stretched between thus supported drive roller 125A and driven roller 125B. The intermediate transfer belt 125 in FIG. 2B has a lower portion in an exposed state from the casing 51. In a state where the intermediate transfer unit 50 is loaded in the apparatus main body 11, the image forming units for the respective colors are located in the apparatus main body 11 below the exposed intermediate transfer belt 125 portion.

Figure 3:
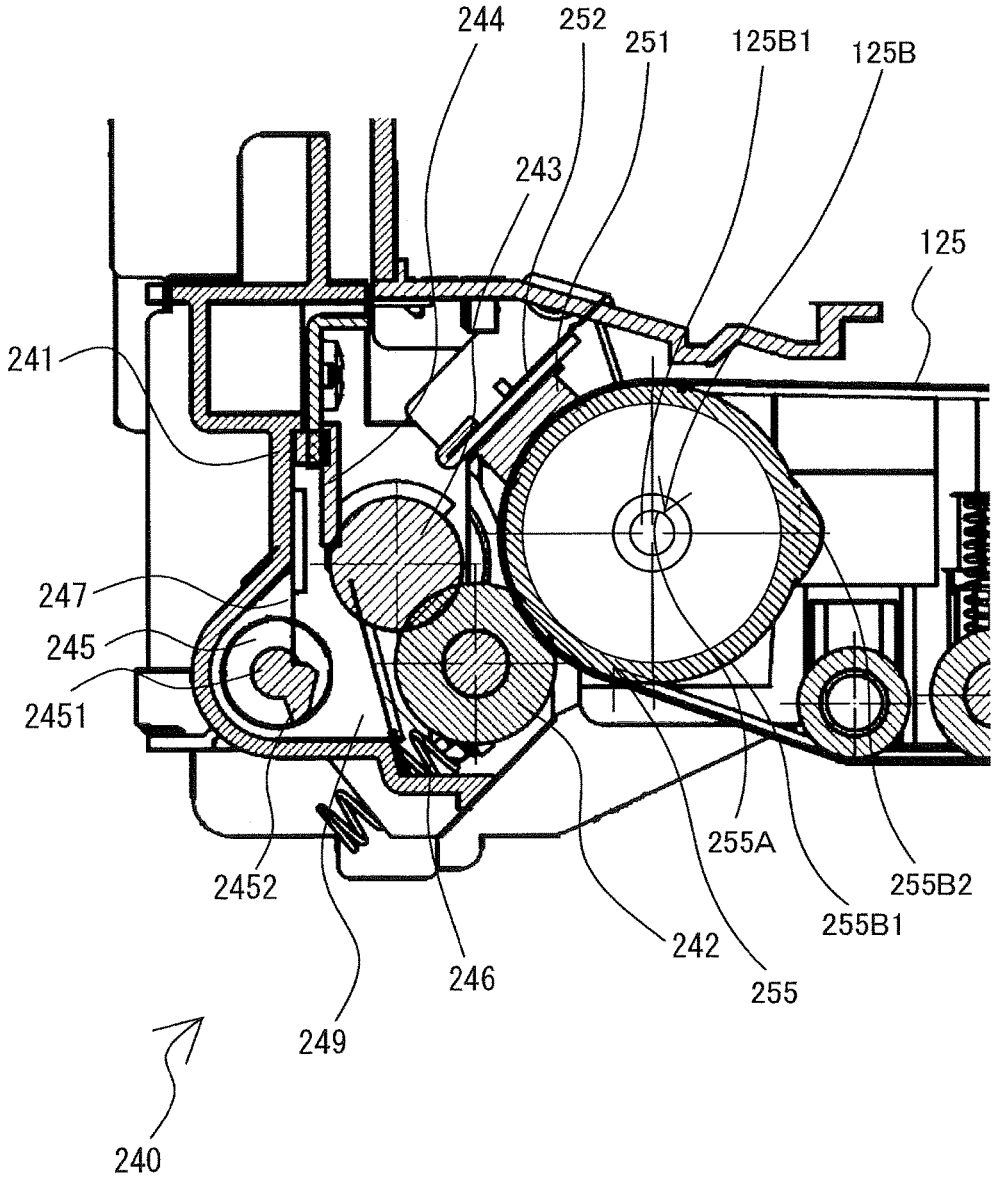
FIG. 3 illustrates a cross-sectional view illustrating a configuration of the cleaning apparatus and a peripheral of the cleaning apparatus according to the one embodiment.

FIG. 3 illustrates a cross-sectional view illustrating a configuration of the cleaning apparatus and the peripheral of the cleaning apparatus according to the one embodiment of the disclosure. The cleaning apparatus 240 includes a casing 241. In the casing 241, a fur brush roller (a removal roller) 242, a recovery roller 243, a cleaning blade 244, a transport screw 245, a sealing member 246, a toner crushing member 247, and a pre-brush 251 that constitute the cleaning apparatus 240 are installed. The casing 241 has a lower-left corner in which a toner housing portion 249 is formed. The cleaning apparatus 240 includes a pressure reducing member 255 integrally installed on the driven roller 125B.

The pre-brush 251 is arranged to oppose the driven roller 125B across the intermediate transfer belt 125. The pre-brush 251 includes a brush unit (not illustrated) constituted of, for example, a nonwoven fabric made of resin filament. The pre-brush 251 is extended in parallel to the driven roller 125B that defines a width direction of the intermediate transfer belt 125. The pre-brush 251 has a dimension identical to a dimension of the intermediate transfer belt 125 in the width direction. The pre-brush 251 is laminated on a lamination sheet metal (a supporting member) 252 located between pressing springs (pressing members) described below and the pre-brush 251. The pre-brush 251 is installed movably in a separating direction that separates from the intermediate transfer belt 125 with respect to the casing 241 via the lamination sheet metal 252. This lamination sheet metal 252 is constituted in a dimension longer than that of the pre-brush 251 (the intermediate transfer belt 125) in the above-described width direction. As described in details later, the pressure reducing member 255 contacting outer end portions of the pre-brush 251 presses the lamination sheet metal 252 against the pressure reducing member 255.

The pre-brush 251 contacts the outer peripheral surface of the intermediate transfer belt 125 in a state of pressed to a side of the intermediate transfer belt 125 with a predetermined pressure by the above-described pressing springs. That is, in the pre-brush 251, the above-described brush unit contacts the outer peripheral surface of the intermediate transfer belt 125 in a state where the brush unit is compressed by the above-described pressure. The pre-brush 251 causes a friction between the outer peripheral surface of the intermediate transfer belt 125 and the pre-brush 251 by this contact while the intermediate transfer belt 125 is running, and applies an electric charge on the remaining toner on this outer peripheral surface to charge the toner. Furthermore, in the pre-brush 251, the above-described pressure is reduced at each constant period predetermined by the pressure reducing member 255 while the intermediate transfer belt 125 is running, as described in details later.

Other than the above-described description, it may be configured that the pre-brush 251 is connected to a power supply unit (not illustrated), and the pre-brush 251 charges the toner on the intermediate transfer belt 125 by applying a voltage on the pre-brush 251 from the power supply unit.

The fur brush roller 242 is arranged to oppose the driven roller 125B across the intermediate transfer belt 125. The fur brush roller 242 rotates while contacting the intermediate transfer belt 125, electrically attracts the toner charged by the pre-brush 251 from the surface (the outer peripheral surface) of the intermediate transfer belt 125, and cleans the surface of the intermediate transfer belt 125. The fur brush roller 242 scrapes off the paper dust with a physical force from the surface of the intermediate transfer belt 125 to clean the surface of the intermediate transfer belt 125. The fur brush roller 242 is constituted by winding, for example, a nonwoven fabric made of a resin filament around a whole circumference of a rotation shaft. The rotation shaft (a first rotation shaft) of the fur brush roller 242 extends in parallel to the driven roller 125B that defines a width direction of the intermediate transfer belt 125 and is pivotally supported by the casing 241.

The recovery roller 243 is, for example, made of metal. The recovery roller 243 contacts a surface of the fur brush roller 242 and electrically recovers the toner recovered by the fur brush roller 242 from the fur brush roller 242. The recovery roller 243 recovers the paper dust recovered by the fur brush roller 242 with a physical force from the fur brush roller 242. A rotation shaft (a second rotation shaft) of the recovery roller 243 extends in parallel to the fur brush roller 242 and is pivotally supported by the casing 241.

The cleaning blade 244 is made of a flat plate-shaped material and extends in parallel to the recovery roller 243. The cleaning blade 244 is installed on the casing 241 such that a distal end portion of the cleaning blade 244 contacts a surface of the recovery roller 243. The cleaning blade 244 scrapes off the toner and the paper dust recovered by the recovery roller 243 from the surface of the recovery roller 243. The toner and the paper dust scraped off drops and stays in the toner housing portion 249.

The toner housing portion 249 is separated from the fur brush roller 242 and the recovery roller 243 by the sealing member (a backflow prevention sheet) 246 and houses the toner and the paper dust recovered by the recovery roller 243 and scraped off by the cleaning blade 244. The toner housing portion 249 includes the transport screw 245.

The transport screw 245 extends in parallel to the recovery roller 243 and has a rotation shaft 2451 pivotally supported by the casing 241. The rotation shaft 2451 of the transport screw 245 has a circumference surface on which a plurality of blades 2452 formed in a spiral pattern in order to transport the toner and the paper dust are located. The plurality of blades 2452 are each formed at an equal interval in an axial direction of the rotation shaft 2451 in a posture with a predetermined angle with respect to the rotation shaft 2451. The blades 2452 rotating about the rotation shaft 2451 causes the transport screw 245 to transport the toner and the paper dust in a direction in which the rotation shaft 2451 extends, that is, to the one end portion in the toner housing portion 249. Thus transported toner and paper dust move into a waste toner tank (not illustrated) from an opening (not illustrated) located in the one end portion in the toner housing portion 249.

The sealing member 246 is a sheet-shaped member made of a flexible material, such as urethane and is installed in the toner housing portion 249 such that a part of the sealing member 246 flexibly contacts the surface of the recovery roller 243. While letting the toner accumulated on the surface of the recovery roller 243 pass through at a contact position between a distal end portion of the sealing member 246 and the surface of the recovery roller 243, the sealing member 246 prevents the toner scraped off from the recovery roller 243 by the cleaning blade 244 from flowing backward from the toner housing portion 249 to a side of the fur brush roller 242. That is, the sealing member 246 functions as the backflow prevention sheet that prevents the backflow of the toner to the fur brush roller 242 side.

The toner crushing member 247 is to crush the toner and the paper dust accumulated in the toner housing portion 249. The toner crushing member 247 is preferred to be made of a material harder than the sealing member 246, and a sheet made of resin as thin as 100 μm, such as polyethylene terephthalate (PET), is used. The toner crushing member 247 is secured to an inner wall surface of the casing 241 and extends in a direction in which the rotation shaft 2451 of the transport screw 245 extends. The toner crushing member 247 is made of, for example, a synthetic resin material that has flexibility.

As described later, the pressure reducing member 255 has a circular plate cam shape and moves the pre-brush 251 in a separating direction that separates from the intermediate transfer belt 125 by pressing end portions of the lamination sheet metal 252 in a direction opposite to pressing by the above-described pressing springs to reduce the above-described pressure onto the pre-brush 251 by the above-described pressing springs at each predetermined constant period. The pressure reducing member 255 is located in one end portion and another end portion in the width direction of the intermediate transfer belt 125 of the driven roller 125B. That is, in the embodiment, as described in FIG. 4 below, a first and a second pressure reducing members 2551 and 2552 (the pressure reducing member 255 is a collective term) are located in the above-described one end portion and another end portion of the driven roller 125B, respectively.

Figure 4:
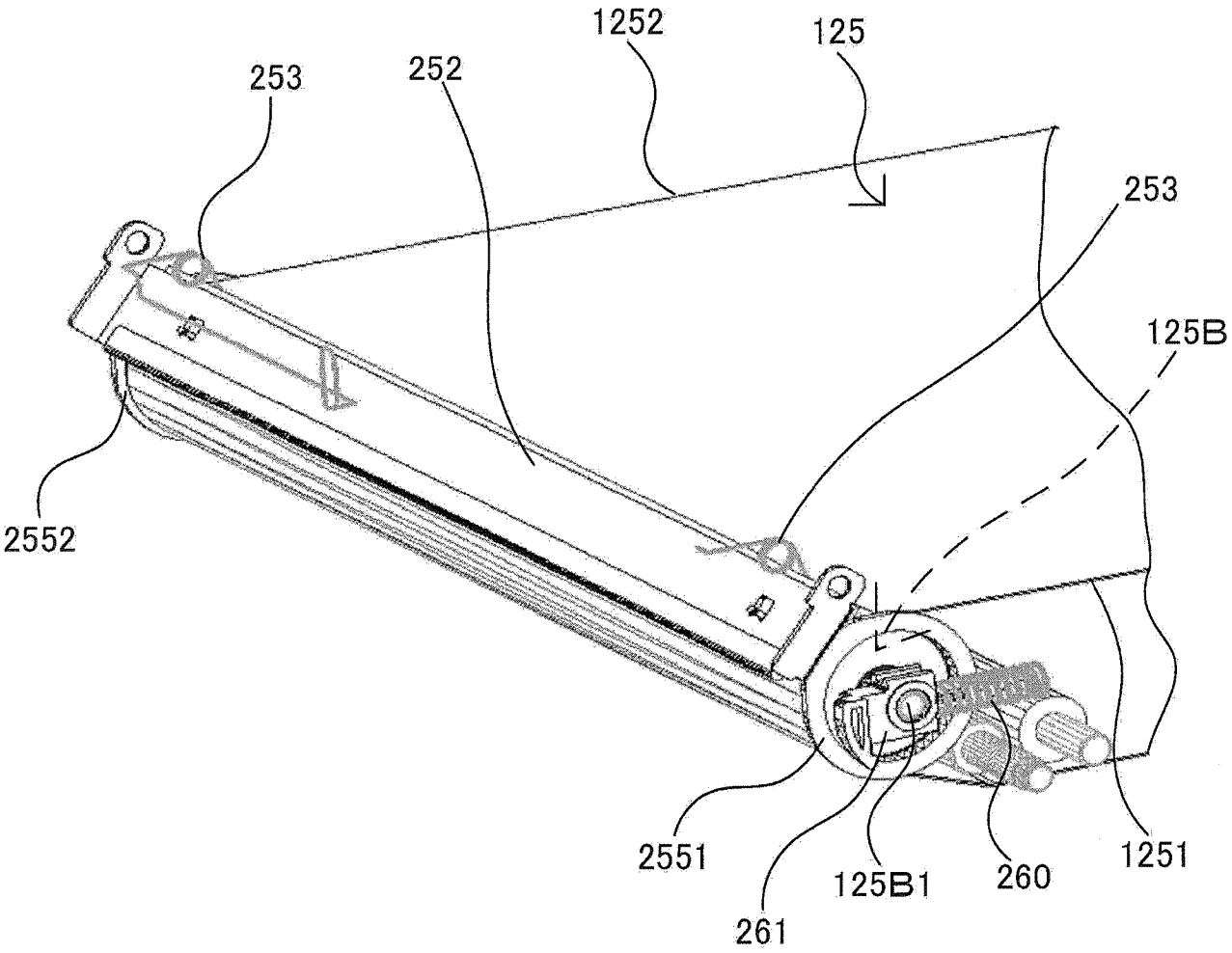
FIG. 4 obliquely illustrates a main part configuration of the cleaning apparatus according to the one embodiment.
Figure 5:
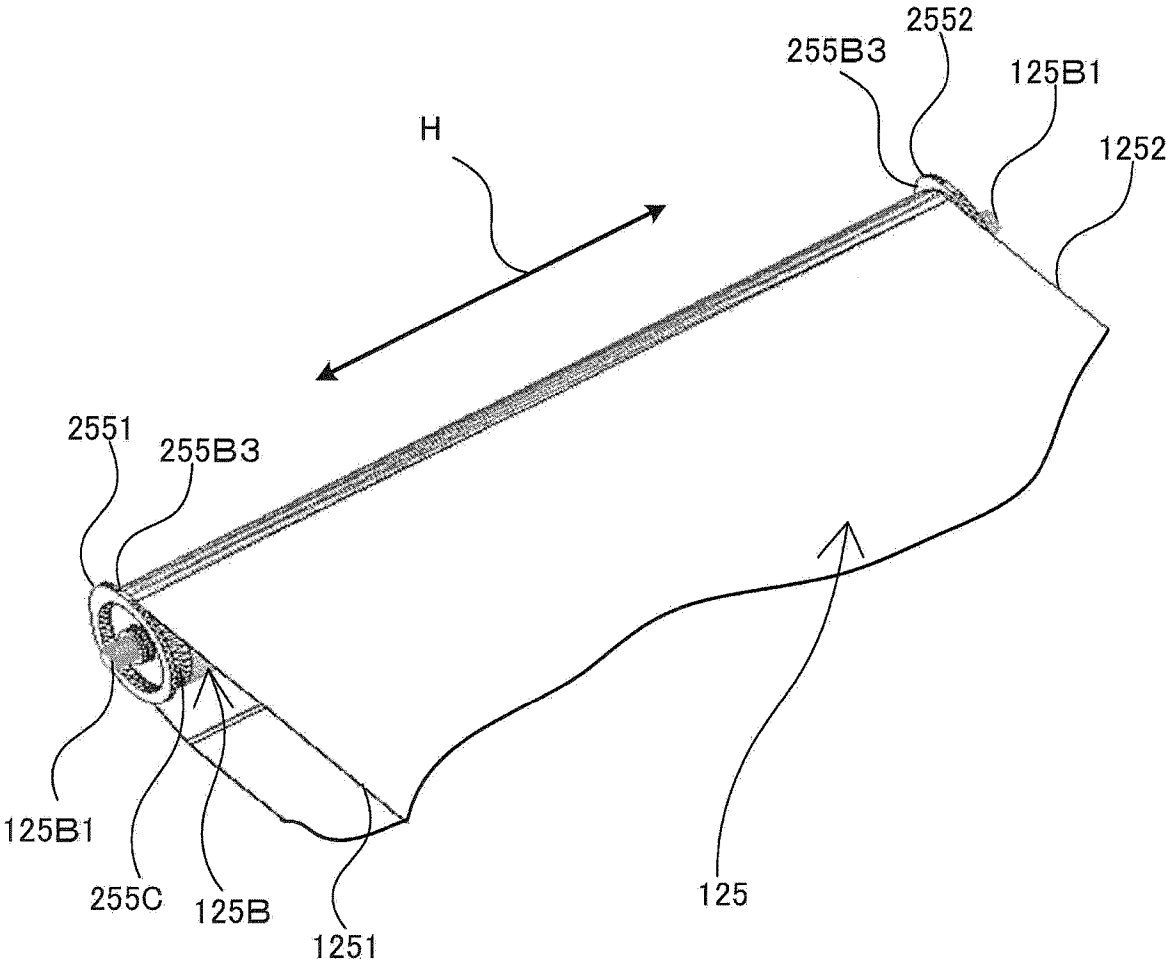
FIG. 5 illustrates a configuration without a pre-brush in the main part configuration of the cleaning apparatus according to the one embodiment.
Figure 6:
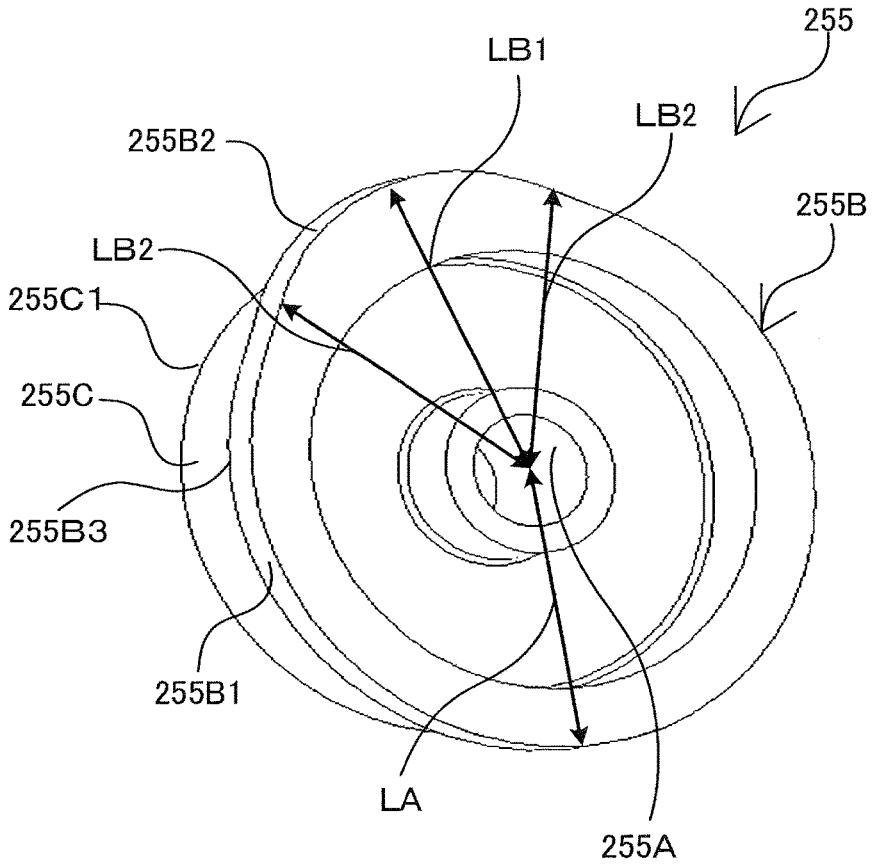
FIG. 6 obliquely illustrates a configuration of a pressure reducing member of the cleaning apparatus according to the one embodiment.
Figure 7A:
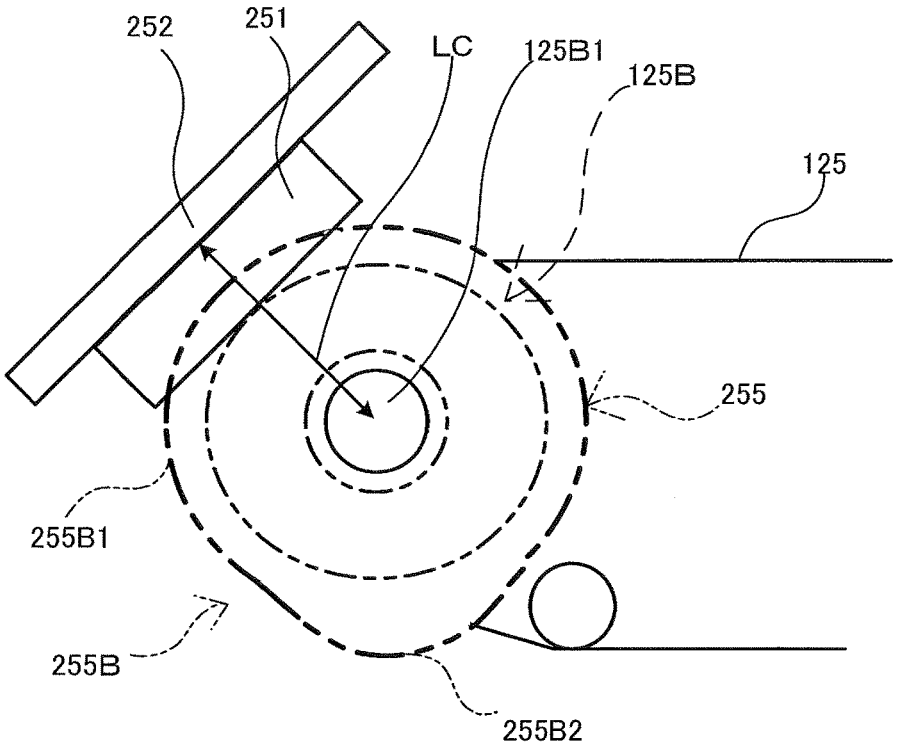
FIG. 7A illustrates a side view illustrating the main part configuration of the cleaning apparatus in a state where the pressure reducing member does not reduce a pressure to the pre-brush.
Figure 7B:
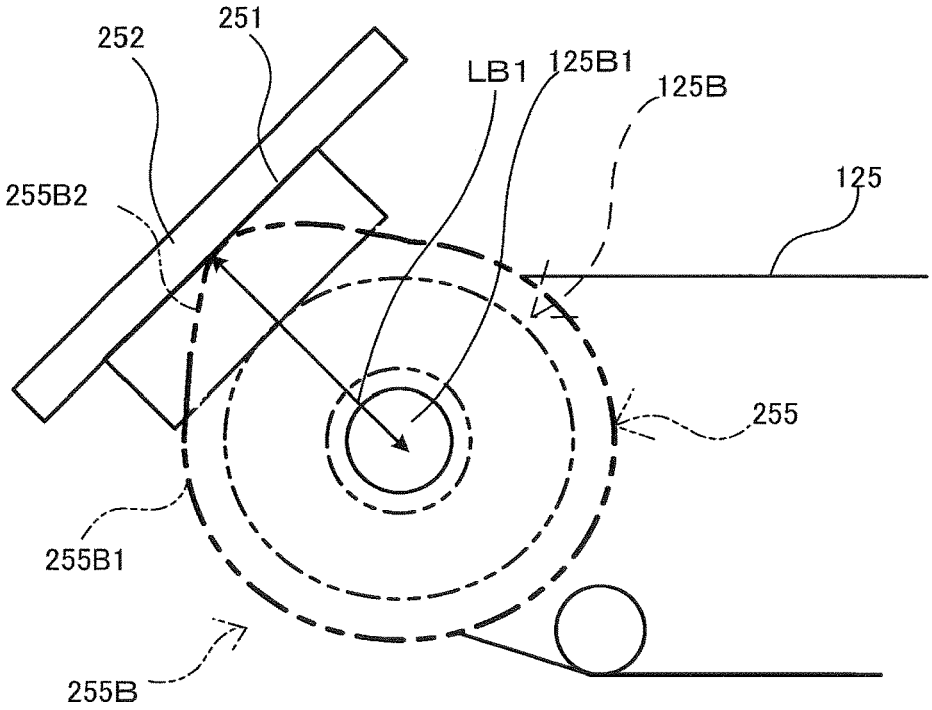
FIG. 7B illustrates a side view illustrating the main part configuration of the cleaning apparatus in a state where the pressure reducing member reduces the pressure to the pre-brush.

Next, with reference to FIGS. 4 to 7B, the pre-brush 251 and the pressure reducing member 255 of the cleaning apparatus 240 will be described. FIG. 4 obliquely illustrates a main part configuration of the cleaning apparatus according to the one embodiment of the disclosure. FIG. 5 illustrates a configuration without the pre-brush in the main part configuration of the cleaning apparatus according to the one embodiment of the disclosure. FIG. 6 obliquely illustrates a configuration of the pressure reducing member of the cleaning apparatus according to the one embodiment of the disclosure. FIG. 7A illustrates a side view illustrating the main part configuration of the cleaning apparatus in a state where the pressure reducing member does not reduce a pressure to the pre-brush. FIG. 7B illustrates a side view illustrating the main part configuration of the cleaning apparatus in a state where the pressure reducing member reduces the pressure to the pre-brush.

The pre-brush 251 is pressed to the intermediate transfer belt 125 side together with the lamination sheet metal 252 with a predetermined pressure by pressing springs 253 in contact with the lamination sheet metal 252 to contact on the outer peripheral surface of the intermediate transfer belt 125.

The pressure reducing member 255 is integrally installed in a rotation shaft 125B1 of the driven roller 125B that rotates in a state of stretching the intermediate transfer belt 125 and applying a predetermined tension to the intermediate transfer belt 125 with a pressing spring 260. The pressure reducing member 255 co-rotates with a rotation of the driven roller 125B.

As an example is illustrated in FIG. 6, the pressure reducing member 255 is constituted to have an approximately cylindrical shape and includes a fitting hole 255A and an outer peripheral portion 255B in a cam shape. The fitting hole 255A is fitted to the rotation shaft 125B1 of the driven roller 125B. The outer peripheral portion 255B has a diameter dimension larger than a diameter of the driven roller 125B and is located around the fitting hole 255A. The outer peripheral portion 255B includes a first outer peripheral portion 255B1 and a second outer peripheral portion 255B2 in arc shapes. The first outer peripheral portion 255B1 has a predetermined first radius (illustrated as "LA" in FIG. 6) from a rotational center of the rotation shaft 125B1 and does not contact the end portion of the lamination sheet metal 252 when not reducing the above-described pressure. The second outer peripheral portion 255B2 has a predetermined cam radius (curvature radius) larger than the first radius and contacts the end portion of the lamination sheet metal 252 when reducing the above-described pressure.

The pressure reducing member 255 is located integrally with the outer peripheral portion 255B in one side of the outer peripheral portion 2556 and further includes a cylinder portion 255C that has a diameter identical to the diameter of the driven roller 125B. On the cylinder portion 255C, the intermediate transfer belt 125 is placed when the fitting hole 255A is fitted to the rotation shaft 12561. This cylinder portion 255C has an abutting surface 255C1. The abutting surface 255C1 abuts on the end portion of the driven roller 125B in a longitudinal direction (illustrated as "H" in FIG. 5, that is, the width direction of the intermediate transfer belt 125) when the fitting hole 255A is fitted to the rotation shaft 125B1. In the pressure reducing member 255, the outer peripheral portion 255B has a contact surface 255B3. The contact surface 255B3 contacts an end surface of the intermediate transfer belt 125 in the above-described width direction when the fitting hole 255A is fitted to the rotation shaft 125B1. With the above-mentioned configuration, in the pressure reducing member 255, when the fitting hole 255A is fitted to the rotation shaft 12561, that is, when the pressure reducing member 255 is integrally installed in the driven roller 125B, an outer peripheral surface of the cylinder portion 255C and the outer peripheral surface of the driven roller 125B constitute a consecutive outer peripheral surface to put the intermediate transfer belt 125 on and the pressure reducing member 255 co-rotates with the driven roller 125B to stretch the intermediate transfer belt 125 as the example in FIG. 5 illustrates.

The second outer peripheral portion 255B2 has, for example, a largest portion and a smallest portion. The largest portion has a largest radius (illustrated as "LB1" in FIG. 6) of the above-described cam radius. The smallest portion is located at both end portions of the second outer peripheral portion 255B2 and has a smallest radius (illustrated as "LB2" in FIG. 6) of the cam radius. For the above-described largest radius LB1, a value larger than a distance (illustrated as "LC" in FIG. 7A) between the lamination sheet metal 252 and a rotational center of the driven roller 125B (that is, a center of the pressure reducing member 255) in a state where the above-described pressing springs 253 apply the above-described pressure is employed. Thus, employing the largest radius LB1 larger than the distance LC causes the pressure reducing member 255 to move the pre-brush 251 in the above-described separating direction via the lamination sheet metal 252 to surely reduce the above-described pressure onto the pre-brush 251. That is, when the second outer peripheral portion 255B2 contacts the end portion of the lamination sheet metal 252, as illustrated in FIG. 7B, the lamination sheet metal 252 contacting the second outer peripheral portion 255B2 of the pressure reducing member 255 to press in the above-described separating direction changes the distance between the lamination sheet metal 252 and the rotational center of the driven roller 125B to the largest radius LB1 from the above-described distance LC. In view of this, the pressure reducing member 255 surely reduces the above-described pressure.

On the outer peripheral portion 255B, as illustrated in FIG. 6, the first outer peripheral portion 255B1 and the above-described smallest portion of the second outer peripheral portion 255B2 are continuously formed in a circumferential direction of the outer peripheral portion 255B. Thus, the first and the second outer peripheral portions 255B1 and 255B2 continuously formed on the outer peripheral portion 255B of the pressure reducing member 255 smoothly changes these outer peripheral surfaces on the first and the second outer peripheral portions 255B1 and 255B2. In view of this, in the embodiment, a reduction operation of the above-described pressure by the pressure reducing member 255 is smoothly performed.

In the embodiment, even when the pressure reducing member 255 reduces the above-described pressure, the pre-brush 251 constantly contacts the outer peripheral surface of the intermediate transfer belt 125. That is, in the pressure reducing member 255, a value of the largest radius LB1 of the second outer peripheral portion 255B2 is equal to or less than a value combining a value of the above-described distance LC and a value of a dimension (that is, a distance between an end portion in the lamination sheet metal 252 side and an end portion in the intermediate transfer belt 125 side of the pre-brush 251) of the above-described brush unit in a state of not compressed by the above-described pressure on the pre-brush 251. That is, when the above-described pressure by the pressing springs 253 is applied to the pre-brush 251, as an example in FIG. 7A illustrates, the above-described brush unit contacts the outer peripheral surface of the intermediate transfer belt 125 in a state of compressed by the pressure. When the above-described pressure is reduced by the pressure reducing member 255, as an example in FIG. 7B illustrates, the above-described brush unit contact the outer peripheral surface of the intermediate transfer belt 125 in a state where the pressure is reduced and the brush unit is extended (that is, the state of not compressed by the above-described pressure).

Other than the above-described description, the pre-brush 251 may be configured to completely separate from the outer peripheral surface of the intermediate transfer belt 125 when the pressure reducing member 255 reduces the above-described pressure by increasing a value of the largest radius LB1 larger than the above-described combined value. However, as described above, it is more preferred when the pre-brush 251 constantly contacts the outer peripheral surface of the intermediate transfer belt 125 when the pressure reducing member 255 reduces the above-described pressure in that the pre-brush 251 can surely charge the toner on the outer peripheral surface.

In the embodiment, as described above, the first and the second pressure reducing members 2551 and 2552 are located in the above-described one end portion and another end portion of the driven roller 125B, respectively. For example, as illustrated in FIG. 5, the first pressure reducing member 2551 is installed in the one end portion of the driven roller 125B in a state where the contact surface 255B3 contacts one end surface 1251 of the intermediate transfer belt 125 in the above-described width direction and the second pressure reducing member 2552 is installed in the other end portion of the driven roller 125B in a state where the contact surface 255B3 contacts another end surface 1252 of the intermediate transfer belt 125 in the above-described width direction.

Other than the above-described description, one pressure reducing member 255 may be configured to be installed in any one of the end portions of the driven roller 125B. Thus, in the embodiment, at least one pressure reducing member 255 is installed in the end portion of the driven roller 125B in a state where the contact surface 255B3 contacts the one or another end surfaces 1251 or 1252 of the intermediate transfer belt 125 in the width direction, thereby ensuring preventing the intermediate transfer belt 125 from meandering.

The first and the second pressure reducing members 2551 and 2552 use the identical shaped pressure reducing member 255. In the embodiment, this ensures preventing the number of components of the cleaning apparatus 240 and the image forming apparatus 1 from increasing. Furthermore, the first and the second pressure reducing members 2551 and 2552 are installed in the one end portion and the other end portion of the driven roller 125B, respectively with the second outer peripheral portions 255B2 arranged at identical positions in the circumferential direction of the driven roller 125B. In view of this, the first and the second pressure reducing members 2551 and 2552 simultaneously move the pre-brush 251 in the above-described separating direction to simultaneously reduce the pressure. That is, the first and the second pressure reducing members 2551 and 2552 move the pre-brush 251 in the separating direction on the second outer peripheral portions 255B2 at an identical timing in association with the rotation of the driven roller 125B.

Other than the above-described description, the first and the second pressure reducing members 2551 and 2552 may be configured to move the pre-brush 251 in the separating direction independently from one another to separately reduce the above-described pressure by arranging the second outer peripheral portions 255B2 at different positions in the circumferential direction of the driven roller 125B. However, as described above, it is more preferred that the first and the second pressure reducing members 2551 and 2552 simultaneously reduce the above-described pressure in that a pressure balance of the pre-brush 251 against the intermediate transfer belt 125 can be maintained.

As described above, in the cleaning apparatus 240 in the embodiment, the pressure reducing member 255 moving the pre-brush 251 in the separating direction that separates from the intermediate transfer belt 125 via the lamination sheet metal 252 reduces the predetermined pressure onto the pre-brush 251 by the pressing springs 253 at each predetermined constant period. In view of this, the cleaning apparatus 240 in the embodiment ensures reducing the paper dust to grow into a large lump with the pre-brush 251 to prevent the paper dust from getting clogged between the recovery roller 243 and the sealing member 246, thereby ensuring preventing the backflow of the toner to the intermediate transfer belt 125 side. Thus, the ensured prevention of the toner from returning to the intermediate transfer belt 125 side ensures preventing an image failure caused by the returned toner from occurring in the image forming apparatus 1 of the embodiment.

Figure 8:
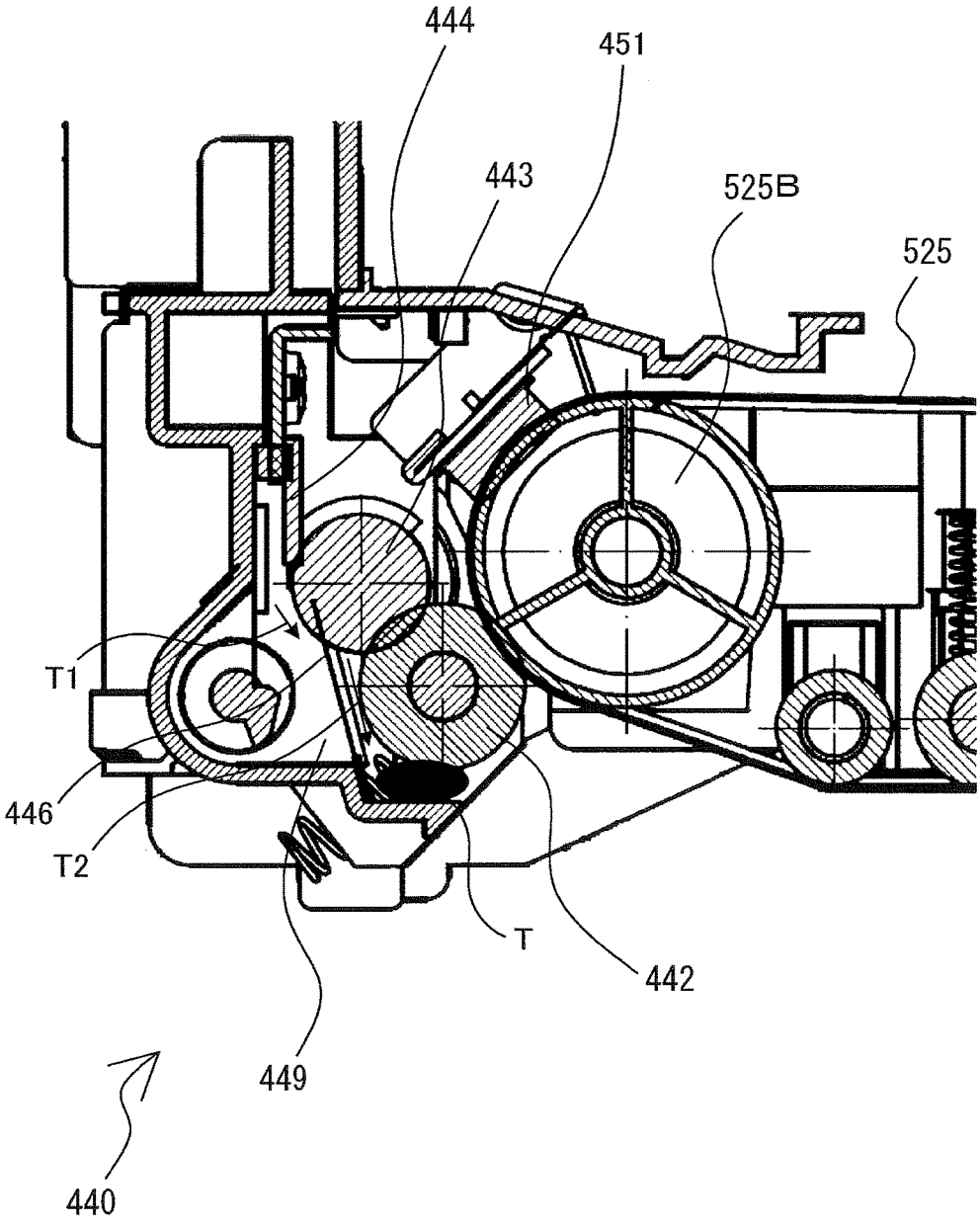
FIG. 8 illustrates a view describing a problem in a comparative example.

FIG. 8 illustrates a view describing a problem in a comparative example. As illustrated in FIG. 8, in a general cleaning apparatus 440 without the pressure reducing member 255 as described above, a paper dust possibly stays between a pre-brush 451 and an outer peripheral surface of an intermediate transfer belt 525 when a driven roller 525B rotates to cause the paper dust to grow into a large lump. Then, if the grown paper dust is transported to the intermediate transfer belt 525, sequentially recovered by a fur brush roller 442 and a recovery roller 443, and further, transported between the recovery roller 443 and a sealing member 446 without being scraped off by a cleaning blade 444 as an arrow T1 illustrates, the transported paper dust possibly gets clogged between the recovery roller 443 and the sealing member 446 and this clogged paper dust possibly cause a slight gap between the recovery roller 443 and the sealing member 446. In view of this, a toner on the recovery roller 443 is not housed in a toner housing portion 449 and possibly gets out below the fur brush roller 442 from the above-described slight gap as an arrow T2 illustrates. Then, if the toner that gets out is accumulated as "T" in FIG. 8, the accumulated toner possibly returns on the outer peripheral surface of the intermediate transfer belt 525 by contacting the fur brush roller 442. As a result, in the image forming apparatus using this general cleaning apparatus 440, an image failure occurs due to the returned toner.

In contrast to this, in the cleaning apparatus 240 of the embodiment, since the pressure reducing member 255 reduces the above-described pressure on the pre-brush 251 once per one rotation (at the predetermined constant period) of the driven roller 125B, a load of the pre-brush 251 against the intermediate transfer belt 125 can be decreased, thereby ensuring creating a state where the paper dust easily passes through between the pre-brush 251 and the outer peripheral surface of the intermediate transfer belt 125. In view of this, the cleaning apparatus 240 of the embodiment ensures moving the paper dust into the toner housing portion 249 with the fur brush roller 242, the recovery roller 243, and the cleaning blade 244 before the paper dust grows into the large lump unlike the above-described comparative example and disposing the paper dust. As a result, the image forming apparatus 1 of the embodiment ensures preventing the image failure due to the toner from occurring unlike the above-described comparative example. Thus, in the embodiment, only locating the pressure reducing member 255 ensures preventing the occurrence of the image failure, thereby ensuring configuring the high performance image forming apparatus 1 at a low cost. Furthermore, in the embodiment, since the pressure reducing member 255 is integrally installed in the driven roller 125B, an installation of the pressure reducing member 255 is easily performable, thereby ensuring easily preventing the configuration of the cleaning apparatus 240, eventually the configuration of the image forming apparatus 1, from getting complicated and increasing the size.

In the above-described description, while the description has been made of the configuration in which the pressure reducing member 255 reduces the above-described pressure on the pre-brush 251 once per one rotation of the driven roller 125B, the disclosure is not limited to this, and it may be configured to reduce the above-described pressure for several times per one rotation of the driven roller 125B. That is, it may be configured to locate a plurality of the second outer peripheral portions 255B2 on the outer peripheral portion 255B of the pressure reducing member 255.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A cleaning apparatus that removes a toner and a paper dust remaining on an intermediate transfer belt, the cleaning apparatus comprising:

a pressing member;

a pre-brush that contacts the intermediate transfer belt in a state of pressed to a side of the intermediate transfer belt with a predetermined pressure by the pressing member to charge the toner remaining on the intermediate transfer belt;

a supporting member located between the pressing member and the pre-brush, the supporting member supporting the pre-brush movably in a separating direction to separate from the intermediate transfer belt;

a removal roller that includes a first rotation shaft extending in a width direction of the intermediate transfer belt and removes the paper dust and the toner charged by the pre-brush on the intermediate transfer belt while contacting the intermediate transfer belt around the first rotation shaft;

a recovery roller that includes a second rotation shaft in parallel to an axial direction of the first rotation shaft and recovers the toner and the paper dust on the removal roller from the removal roller by contacting the removal roller while rotating about the second rotation shaft;

a cleaning blade that extends in parallel to an axial direction of the second rotation shaft, the cleaning blade contacting the recovery roller to scrape off the toner and the paper dust on the recovery roller;

a sealing member that runs in parallel to the first and the second rotation shafts;

a toner housing portion separated from the removal roller and the recovery roller by the sealing member, the toner housing portion housing the toner and the paper dust recovered by the recovery roller and scraped off by the cleaning blade; and a pressure reducing member that moves the pre-brush in the separating direction by pressing the supporting member in a direction opposite to pressing by the pressing member to reduce the pressure onto the pre-brush by the pressing member at every predetermined constant period, wherein the pressure reducing member includes:

a fitting hole fitted to a rotation shaft of a rotation roller rotating at which the intermediate transfer belt is stretched; and an outer peripheral portion in a cam shape that has a diameter dimension larger than a diameter of the rotation roller, the outer peripheral portion being located around the fitting hole, and the outer peripheral portion includes a first outer peripheral portion and a second outer peripheral portion, the first outer peripheral portion having a predetermined first radius, the first outer peripheral portion not contacting the supporting member when not reducing the pressure, the second outer peripheral portion having a predetermined cam radius larger than the first radius, the second outer peripheral portion contacting the supporting member when reducing the pressure, wherein the pressure reducing member is located integrally with the outer peripheral portion in one side of the outer peripheral portion, the pressure reducing member having a diameter identical to the diameter of the rotation roller, the pressure reducing member further including a cylinder portion on which the intermediate transfer belt is placed when the fitting hole is fitted to the rotation shaft, the cylinder portion has an abutting surface that abuts on an end portion in a longitudinal direction of the rotation roller when the fitting hole is fitted to the rotation shaft, and the outer peripheral portion has a contact surface that contacts an end surface of the intermediate transfer belt in the width direction when the fitting hole is fitted to the rotation shaft.

2. The cleaning apparatus according to claim 1, wherein the pressure reducing member includes a first pressure reducing member and a second pressure reducing member, the first pressure reducing member is, in a state of contacting one end surface in the width direction, installed in the one end surface of the rotation roller, and the second pressure reducing member is, in a state of contacting another end surface in the width direction, installed in another end surface of the rotation roller.

3. The cleaning apparatus according to claim 2, wherein the first and the second pressure reducing members are installed in the one end portion and the other end portion of the rotation roller while the second outer peripheral portions are arranged at identical positions in a circumferential direction of the rotation roller.

4. The cleaning apparatus according to claim 2, wherein the first and the second pressure reducing members are installed in the one end portion and the other end portion of the rotation roller while the second outer peripheral portions are arranged at different positions in a circumferential direction of the rotation roller.

5. An image forming apparatus comprising:

an image forming unit that includes the intermediate transfer belt; and the cleaning apparatus according to claim 1, wherein the image forming apparatus removes a toner and a paper dust remaining on the intermediate transfer belt with the cleaning apparatus.

* * * * *